United States Patent [19]

Ohsawa

[11] 4,100,425

[45] Jul. 11, 1978

[54] APPARATUS FOR DETECTING BREAK OR SLACKENING OF YARN

[76] Inventor: Shiuji Ohsawa, No. 10-2, 2-chome, Tsutsumi-cho, Kiryu City, Gumma Prefecture, Japan

[21] Appl. No.: 750,566

[22] Filed: Dec. 14, 1976

[51] Int. Cl.[2] ..... D02H 13/08; D04B 35/16

[52] U.S. Cl. ..... 250/561; 28/187

[58] Field of Search ..... 28/51, 187; 73/160; 250/572, 561; 57/81

[56] References Cited

U.S. PATENT DOCUMENTS

| | | | |
|---|---|---|---|
| 2,271,178 | 1/1942 | Blom | 28/51 |
| 2,389,625 | 11/1945 | Lambach et al. | 28/51 |
| 2,725,202 | 11/1955 | McBride | 28/51 X |
| 3,041,461 | 6/1962 | Lindemann et al. | 250/572 |
| 3,084,499 | 4/1963 | Harvey, Jr. | 57/81 |
| 3,677,307 | 7/1972 | Fiorucci | 250/272 |
| 3,752,997 | 8/1973 | MacKenzie et al. | 250/272 |

*Primary Examiner*—Daniel M. Yasich
*Attorney, Agent, or Firm*—Haseltine, Lake & Waters

[57] ABSTRACT

An apparatus for detecting break or unusual slackening of a yarn in a plurality of yarns, comprising a plurality of a units each having a magazine block formed with an aperture to form part of a continuous bore in the assembly of the magazine blocks, a light-intercepting element having a first angular position uncovering the aperture and a second angular position covering the aperture and a yarn-pass element connected to the light-intercepting element, the yarn-pass element of each of the detecting units being retained by each of the yarns in a raised position holding the associated light-intercepting element in the first angular position thereof; light-emitting means positioned at one end of the bore in the assembly of the detecting units; and light-sensitive signal generating means positioned at the other end of the bore, the beam of light from the light-emitting means being passed throughout the bore and reaching the signal generating means when the light-intercepting elements of all of the detecting units are out of the second angular positions thereof and being intercepted by the light-intercepting element of at least one of the detecting units when the yarn allocated to the particular detecting unit breaks or unusually slackens and allows the light-intercepting element to angularly fall into the second angular position thereof by reason of the weight thereof.

20 Claims, 9 Drawing Figures

APPARATUS FOR DETECTING BREAK OR SLACKENING OF YARN

The present invention relates to an apparatus for detecting a break or unusual slackening of a continuous fibrous line such as a yarn, thread or filament in a textile production equipment such as for example a creel for a spinning frame or beam warper, a yarn sizing or taping machine, a yarn winder of a doubling frame, and a roving frame for manipulating glass fibers.

In the manufacture of textile fabrics or other fibrous products formed of myriads of continuous yarns, threads or filaments (all of which will be hereinafter represented by yarns for brevity of description), break or unusual slackening of yarns as invited during production of such products causes critical deterioration of the quality and accordingly the commercial values of the products. Various kinds of detecting devices have therefore been proposed and put to practical use for the detection of such an incident during yarn feeding operation. A typical example of the conventional detecting devices is an automatic tension detector which uses drop arms which are respectively allocated to the yarns in use and each of which is retained in a raised angular position when the yarn allocated to the drop arm is properly tensioned. The drop arms respectively constitute movable contacts of normally-open switch units which are electrically connected in parallel to the coil of a relay switch of a solenoid-operated stop motion provided for the yarn manipulating equipment. In the event the yarn allocated to one of the drop arms happens to break or unusually slacken and becomes unable to retain the drop arm in the raised angular position during manipulation of the yarns, the particular drop arm automatically falls or downwardly turns from the raised angular position thereof by reason of its own weight and strikes against the movable contact of the associated switch unit. The switch unit is accordingly caused to close and energizes the solenoid-operated stop motion through the relay switch and brings the equipment to a full stop, enabling an operator to re-join the ends of the broken yarn or to readjust the tension in the unusually slackened yarn.

In order that each of the drop arms of the tension detecting device of this nature be capable of reliably actuating the associated switch unit when the drop arm falls from the raised angular position thereof, it is important that each drop arm by heavy enough to mechanically drive the movable contact of the switch unit with certainty when the drop arm strikes against the movable contact. When, however, such a heavy drop arm is retained in the raised angular position by the yarn which has its tension strictly controlled, the yarn is forced downwardly due to the weight of the drop arm and tends to be excessively taut. This provides added complications in the design considerations of the tension control means for the yarns. If, furthermore, the yarn for a drop arm happens to be unsteadily slackened and cause waving, the drop arm wobbles up and down and may cause the associated switch unit to hunt. This brings about frequently repeated closing and opening motions of the movable contact of the switch unit and, as a consequence, not only accelerates the wear of the contact elements of the switch unit due to surface desctruction caused by the repeated impacts on the elements and the sparks repeatedly produced between the elements but many cause undesired actuation of the stop motion.

It is, accordingly, an important object of the present invention to provide an improved tension detecting apparatus having drop arms or detecting elements which are sufficiently light in weight and which will therefore not produce sizeable tensions in the yarns retaining the detecting elements.

It is another important object of the present invention to provide an improved tension detecting apparatus in which each of the detecting elements thereof is not required to mechanically drive any movable element or elements when the detecting element falls from the raised angular position thereof in response to a break or unusual slackening of the yarn to which the detecting element is allocated.

It is still another important object of the present invention to provide an improved tension detecting apparatus in which the angular movement of each of the detecting elements thereof is not directly converted into a mechanical motion of any movable element or elements but converted into a change in the quantity of light in a predetermined path.

Yet, it is another important object of the present invention to provide an improved tension detecting apparatus which is simple in construction, reliable in operation, easy and economical to manufacture on a large-scale commercial basis and for maintenance and servicing, and ready to be applied to any yarn manipulating equipment using any desired number of yarns at a time.

In accordance with the present invention, these and other objects are accomplished basically in an apparatus comprising a detector assembly which has a substantially horizontal longitudinal direction and which comprises a plurality of detecting units juxtaposed end-to-end in the longitudinal direction of the detector assembly, each of the detecting units comprising a magazine block which has front and rear ends substantially parallel with the longitudinal direction of the detector assembly and which is formed with an aperture which is open at both side ends of the magazine block, the respective apertures in the magazine blocks of the individual detector units having center axes which are substantially in line with one another and forming an elongated continuous bore throughout the length of the detector assembly substantially in parallel with the longitudinal direction of the detecting assembly, a light-intercepting element which is rotatable on the magazine block about a fixed axis substantially parallel with the longitudinal direction of the detector assembly and which has an outer arm portion extending forwardly from the fixed axis and projecting outwardly from the front end of the magazine block and an inner arm portion extending rearwardly from the fixed axis, the light-intercepting element being rotatable about the above mentioned axis between a first angular position having the inner arm portion located out of alignment with the aperture in the magazine block and a second angular position having the inner arm portion aligned with the aperture for covering the aperture at one axial end of the aperture, and a yarn-pass element mounted on the outer arm portion of the light-intercepting element and movable with the light-intercepting element between a first vertical position and a second vertical position which is lower than first vertical position, the yarn-pass element being in the first and second vertical positions thereof when the light-intercepting element is in the first and second angular positions, respectively, thereof, the light-intercepting element being biased to turn about the aforesaid fixed axis toward the second angular position thereof; light-emitting means positioned in proximity to one axial end of the continuous bore in the detector assembly for projecting a beam of light into the bore, the beam of light being allowed to reach the other end of the bore when the respective light-intercepting elements of all of the detecting units are in the first angular positions thereof and intercepted in the bore when the light-intercepting element of at least one of the detecting units is in the second angular position thereof; and light-sensitive signal generating means positioned in proximity to the other end of the bore in the detector assembly and operative to deliver an output signal in response to interception of the beam of light in the bore.

The other or further detailed features of the apparatus according to the present invention will be understood from the following description taken in conjunction with the accompanying drawings in which like reference numerals designate the same or corresponding elements, members, structures and spaces throughout the drawings and in which.

Figure 1:
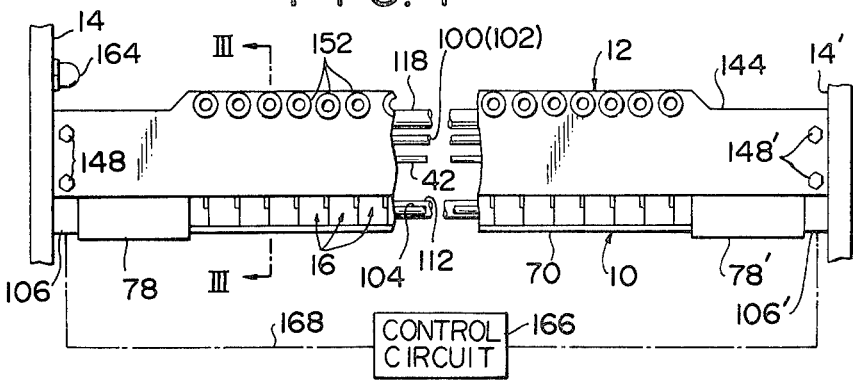
FIG. 1 is a partially cut-away front view of a preferred embodiment of the apparatus according to the present invention.
Figure 4:
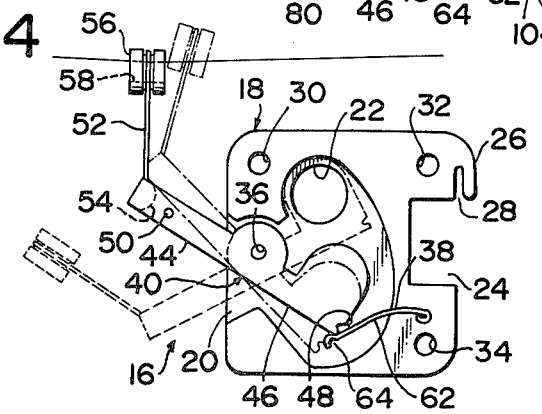
FIG. 4 is a side elevation of a detecting unit which forms part of the detector assembly illustrated in FIG. 2.
Figure 7:
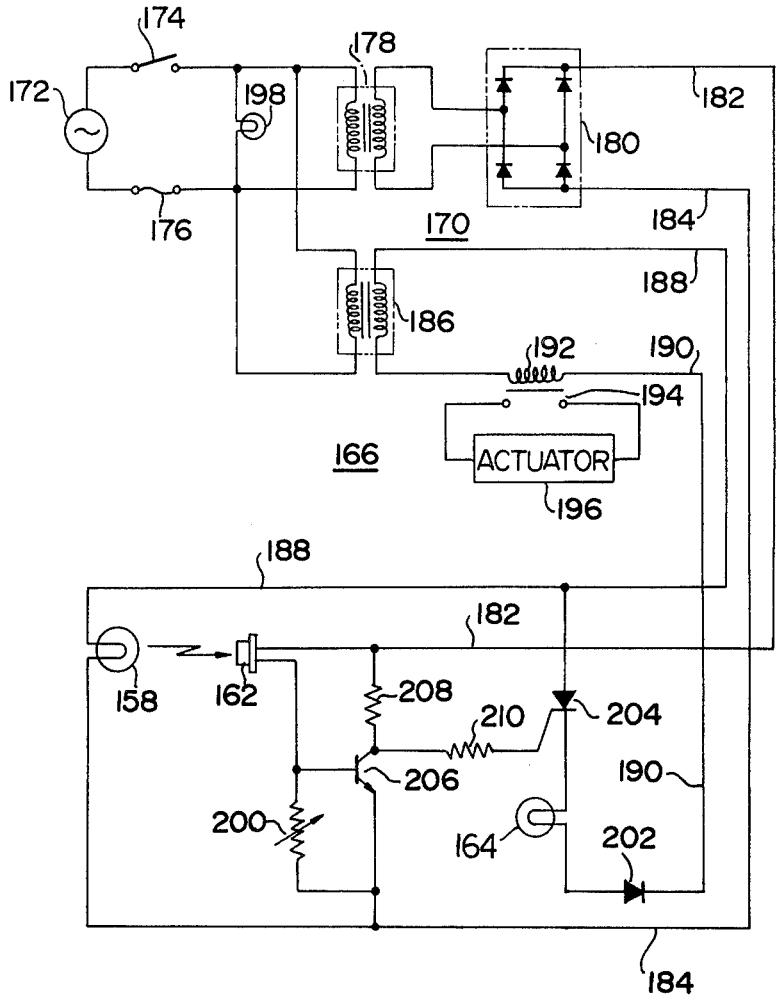
Figure 8:
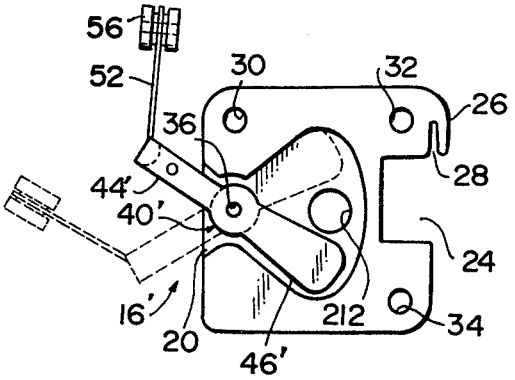
Figure 9:
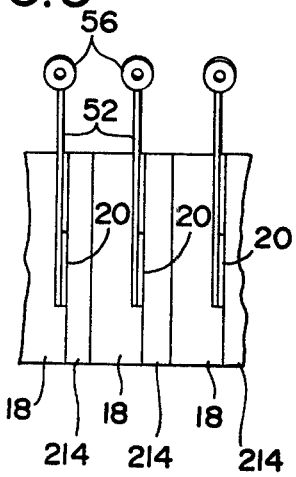

FIG. 7 is a schematic diagram showing a preferred example of the control circuit incorporated into the embodiment of FIG. 1, FIG. 8 is a view similar to FIG. 4 but shows a detecting unit forming part of the detector assembly of another preferred embodiment of the present invention; and FIG. 9 is a fragmentary front view of a longitudinal portion of the assembly of the detecting units in still another preferred embodiment of the present invention.

Referring to FIG. 1 of the drawings, an apparatus embodying the present invention largely comprises a detector assembly 10 and a yarn guide structure 12 positioned in front of the detector assembly 10 and is fixedly mounted on a suitable frame structure which is shown comprising a pair of spaced parallel vertical columns 14 and 14'. While an apparatus according to the present invention may be utilized for any of yarn, thread or filament manipulating operations such as for example the sizing of yarns, doubling of threads for forming yarns or roving of glass fibers, the apparatus embodying the invention is assumed, by way of example, to be used for the beam-warping of yarns from a creel for use with a warping machine. The columns 14 and 14' shown in FIG. 1 are, thus, assumed to form part of the frame structure of a creel holding a number of supply bobbins (not shown).

Figure 2:
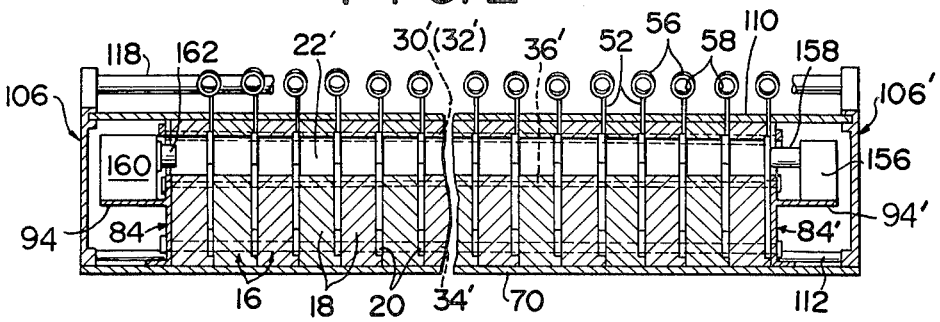
FIG. 2 is a partially cut away longitudinal sectional view of the detector assembly forming part of the embodiment shown in FIG. 1.

Turning to FIG. 2, the detector assembly 10 has a horizontal longitudinal direction and comprises a number of detecting units 16 which are juxtaposed end-to-end in the longitudinal direction of the detector assembly 10. As will be seen more clearly in FIGS. 3, 4 and 5, each of the detecting units 16 comprises a magazine block 18 having in one side wall a shallow depression 20 which is open at the front end of the block 18, the other side wall of the magazine block having a substantially flat face as will be seen from FIG. 2. The magazine block 18 is further formed with an aperture 22 which is open at both ends thereof, viz., has one end open at the bottom of the depression 20 in one side wall and the other end open at the substantially flat face of the other side wall of the block 18. The respective apertures 22 in the individual magazine blocks 18 which are assembled together in a row have center axes which are substantially in line with one another in the longitudinal direction of the detector assembly 10 and thus form an elongated continuous bore 22' which extends longitudinally of the detector assembly 10 throughout the length of the row of the magazine blocks 18, as shown in FIG. 2. For the purpose of reducing the height of the magazine block 18 and accordingly the overall height of the apparatus as a whole, it is preferable that the aperture 22 in each magazine block 18 be located in an upper wall portion of the block as shown. Each of the magazine blocks 18 has a rear wall formed with a recess 24 which is open at both side ends of the block 18, the rear wall of the block 18 having an upper ledge portion 26 overhanging the recess. The upper ledge portion 26 of the magazine block 18 is formed with a vertical slot 28 (FIGS. 4 and 5) which is open at the lower end and side ends of the ledge portion 26 and has a front end substantially flush with the outer face of the lower portion of the rear wall of the block 18. When the individual magazine blocks 18 are assembled together as above described, the respective recesses 24 in the magazine blocks 18 are substantially aligned with one another in the longitudinal direction of the detector assembly 10 and form an elongated continuous groove 24' extending longitudinally of the detector assembly 10 throughout the row of the magazine blocks 18, as will be seen from FIG. 3. Likewise, the respective slots 28 in the individual magazine blocks 18 assembled together are substantially aligned with one another in the longitudinal direction of the detector assembly 10 and thus form an elongated continuous groove 28' extending throughout the length of the row of the magazine blocks 18, as will be seen from FIG. 3. Each magazine block 18 is further formed with through holes 30, 32, 34 and 36. Each of the through holes 30, 32 and 34 in the magazine block 18 is open at both side ends of the block 18 and is substantially aligned with the respectively corresponding holes in the other magazine blocks 18 so that elongated continuous bores 30', 32' and 34' are formed in the assembly of the blocks 18 in longitudinal directions of the assembly, as shown in FIG. 2. Of the through holes 30, 32, 34 and 36 formed in each magazine block 18, the through hole 36 in particular has one open end at the bottom of the depression 20 in one side wall of the block and the other open end at the flat face of the other side wall and is located in the neighborhood of the front end of the block 18 and on a horizontal plane below the aperture 22 in the magazine block 18 as seen in FIG. 4. The side wall of the magazine block 18 formed with the depression 20 has a land portion which has an inner edge defining the depression 20 and which is formed with a groove 38 which is open at its front end to a lower portion of the depression 20.

Each of the detecting units 16 further comprises a light-intercepting element 40 which has an intermediate fulcrum portion pivotally mounted on a shaft 42 passed through the above described bore 36' in the detector assembly 10. The respective light-intercepting elements 40 of the individual detecting units 16 are, thus, jointly mounted on the shaft 42 and are rotatable independently of one another on the shaft 42 in planes perpendicular to the longitudinal direction of the detector assembly 10. The light-intercepting element 40 of each of the detecting units 16 has a substantially straight outer arm portion 44 extending away from the fulcrum portion of the element 40 and projecting outwardly from the vertical slot formed at the front open end of the depression 20 between the neighboring magazine blocks 18. The light-intercepting element 40 further has an inner arm portion 46 extending in the depression 20 from the fulcrum portion of the magazine block 18 in a generally opposite direction to the outer arm portion 44. The inner arm portion 46 of the light-intercepting element 40 is movable about the center axis of the shaft 42 in an arc passing through an extension of the center axis of the aperture 22 in the magazine block and has a substantially semicircularly curved upper edge portion 46*a*. The light-intercepting element 40 has a V-shaped notch 48 formed in the vicinity of the lower end of the inner arm portion 46 and, preferably, a hole 50 in the outer arm portion 44 for the reason that will be clarified as the description proceeds. An elongated connecting rod 52 constituted by, for example, a metal wire is fixedly connected or welded as at 54 to the foremost end of the outer arm portion 44 of the light-intercepting element 40 and has fixedly mounted at its leading end a yarn-pass pass element 56 which has an eyelet 58 having a center axis in a vertical plane perpendicular to the center axis of the shaft 42 supporting the light-intercepting element 44. When the light-intercepting element 40 assumes a certain rotational position relative to the magazine block 18, the connecting rod 52 has a vertically upright position having the eyelet 58 in the yarn-pass element 56 located in the path of a yarn 60 which is stretched in a substantially horizontal direction over the magazine block 18. The light-intercepting element 40 is thus rotatable about the center axis of the shaft 42 between a first angular position having the outer arm portion 44 upwardly inclined and the yarn-pass element 56 in the above described position as indicated by full lines in FIGS. 3, 4 and 5, a second angular position having the outer arm portion 44 downwardly inclined and the yarn-pass element 56 positioned below the path of the yarn 60 as indicated by dotted lines in FIG. 4, and a third angular position having the outer arm portion 44 upwardly inclined beyond the above mentioned first angular position and the yarn-pass element 56 positioned to have its eyelet 50 located above the path of the yarn 60 as indicated by dot-and-dash lines in FIG. 4. In this instance, it is of importance that the depression 20 in the magazine block 18 be configured in such a manner as to accommodate the rotational movement of the light-intercepting element between these angular positions and to be capable of stopping the light-intercepting element 40 in the second angular position thereof when the element 40 is moved from the first angular position into the second angular position. When the light-intercepting element 40 is in the first angular position thereof, the inner arm portion 46 of the element 40 is downwardly inclined and is positioned below the open end of the aperture 22 in the magazine block 18. When the light-intercepting element 40 is in the second angular position thereof, the inner arm portion 46 of the element 40 is upwardly inclined and totally covers the open end of the aperture 22 in the magazine block 18. When, furthermore, the light-intercepting element 40 is in the third angular position thereof, the inner arm portion 46 of the element 40 is downwardly inclined beyond the first angular position of the element 40. The light-intercepting element 40 is biased to turn toward the second angular position thereof by reason of the moment of the force resulting from the weights of the outer arm portion 44 of the light-intercepting element 40, the connecting rod 52 and the yarn-pass element 56. The moment of the force thus biasing the light-intercepting element 40 to turn toward the second angular position thereof can be adjusted by varying the quantity of the weld 54 between the light-intercepting element 40 and the connecting rod or by applying an additional weight to the outer arm portion 44 of the light-intercepting element 40 through the hole 50 formed in the arm portion 44. Such an additional weight may be formed by a weld filling the hole 50 in the arm portion 44.

A retainer spring 62 is fixedly anchored to the magazine block 18 through the previously described groove 48 formed in the land portion on one side of the block 18. The retainer spring 62 projects forwardly in the depression 20 and has at its foremost end a V-shaped hook portion 64 which is located in the depression 20 so as to be snugly received in the V-shaped notch 48 in the inner arm portion 46 of the light-intercepting element 40 by a snap action when the light-intercepting element 40 is moved (usually by a finger pressure) into the third angular position thereof. The light-intercepting element 40 thus engaged by the retainer spring 62 is held in the third angular position thereof.

Figure 5:
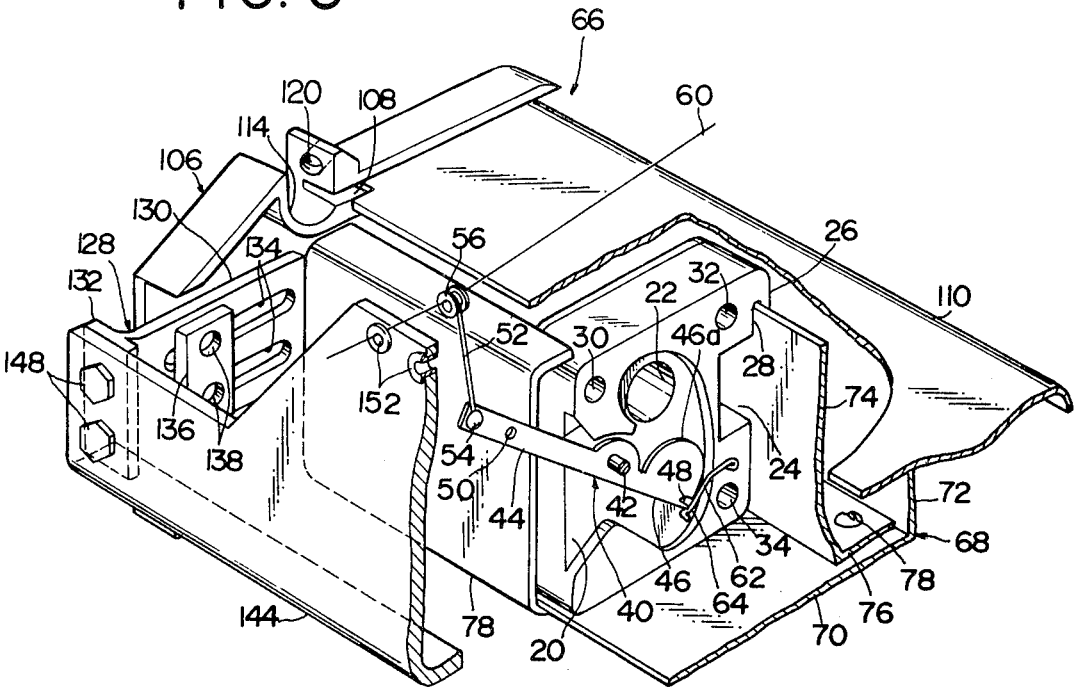
FIG. 5 is a fragmentary perspective view showing one longitudinal end portion of the embodiment of FIG. 1.

The detector assembly 10 further comprises a casing structure 66 which is best seen in FIG. 5. The casing structure 66 comprises a horizontally elongated external support plate 68 having an L-shaped cross section and thus comprising a substantially flat horizontal bottom wall portion 70 and a substantially flat vertrical rear wall portion 72 upwardly bent from the lower end of the bottom wall portion 70. As will be better seen from FIG. 3, the horizontal bottom wall portion 70 of the external support plate 68 has a depth which is greater than the depth of the assembly of the magazine blocks 18 when viewed in a fore-and-aft direction of the assembly, while the vertical rear wall portion 72 of the support plate 68 is substantially equal in height to the assembly of the magazine blocks 18. Furthermore, the external support plate 68 has a length which is greater than the length of the assembly of the magazine blocks 18 in the longitudinal direction of the detector assembly 10 and thus projects from both longitudinal or side ends of the assembly of the magazine blocks 18, forming open spaces on both sides of the assembly of the magazine blocks 18, as will be seen in FIG. 2. The casing structure 66 of the detector assembly 10 further comprises a horizontally elongated internal support plate 74 having a horizontal bottom wall portion 76 which is fixedly secured to the upper face of the horizontal bottom wall portion 70 of the external support plate 68 by suitable fastening means such as screws 77. The internal support plate 74 has a vertical wall portion forwardly spaced apart from the vertical rear wall portion 72 of the external support plate 68 and thus forms an elongated open space between the respective vertical wall portions of the support plates 68 and 74 throughout the length of the internal support plate 74. The assembly of the magazine blocks 18 is securely but detachably supported on the external and internal support plates 68 and 74 with the individual magazine blocks 18 resting on the upper face of the horizontal bottom wall portion 70 of the external support plate 68 and with an upper end portion of the internal support plate 74 snugly but disengageably received in the continuous groove 28' formed in the assembly of the magazine blocks 18 by the vertical slots 28 in the respective ledge portions 26 of the individual magazine blocks 18. The continuous groove 24' formed in the assembly of the magazine blocks 18 by the respective recesses 24 in the individual magazine blocks 18 is, thus, closed at its rear end by the vertical wall portion of the internal support plate 74.

Figure 3:
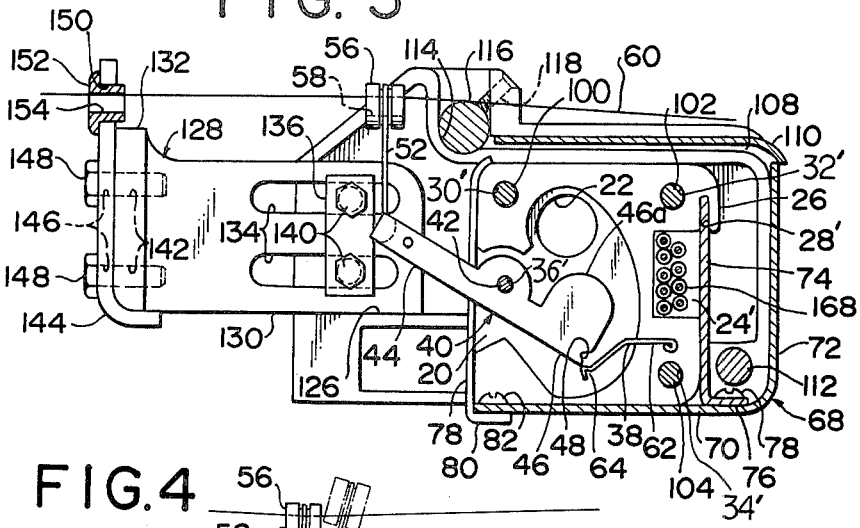
FIG. 3 is a cross sectional view taken on line III—III of FIG. 1.

The casing structure 66 of the detector assembly 10 further comprises a pair of front covers 78 and 78' (FIG. 1) respectively vertically covering the above mentioned open spaces on both sides of the assembly of the magazine blocks 18 at the front ends of the open spaces, as will be better seen in FIG. 5 in which only one front cover 78 is shown. As seen in FIG. 3, the front cover 78 has a horizontal bottom wall portion 80 which is fixedly secured to the lower face of the horizontal bottom wall portion 70 of the external support plate 68 by suitable fastening means such as screws 82. Though not shown, the other front cover 78' is configured similarly to the front cover 78 and is fixedly connected to the bottom wall portion 70 of the external support plate 68.

Figure 6:
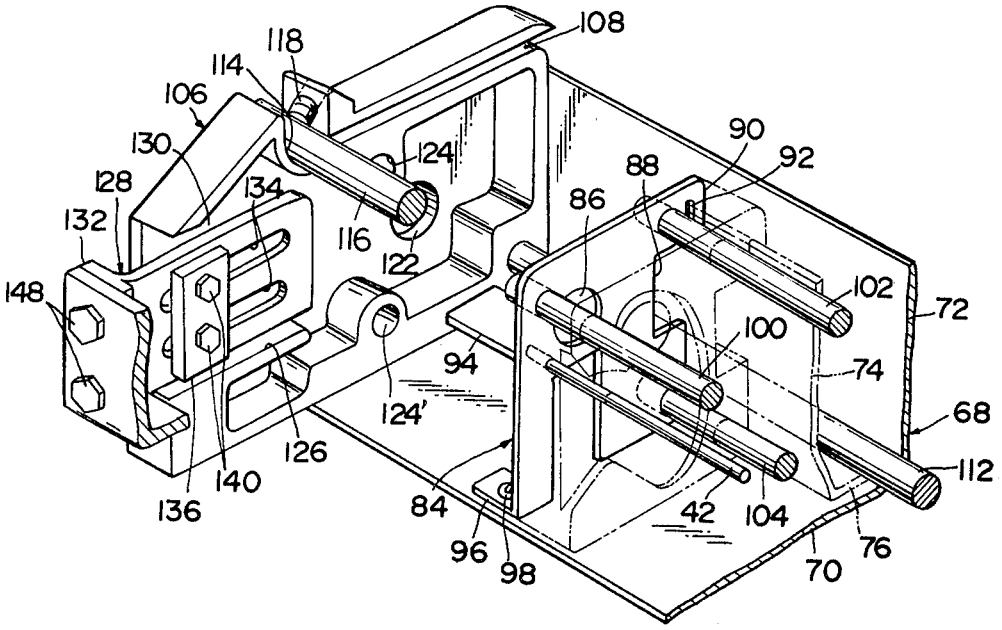
FIG. 6 is also a fragmentary perspective view showing the internal construction of the portion illustrated in FIG. 5.

On both sides of the assembly of the magazine blocks 18 are positioned clamping brackets 84 and 84' (FIG. 2) which have external contours identical with the external contour of each of the magazine blocks 18 when viewed in the longitudinal direction of the detector assembly 18 as will be seen from FIG. 6. As illustrated in FIG. 6, the clamping bracket 84 is formed with an aperture 86, a recess 88, a ledge portion 90 and a vertical slot 92 which are respectively similar to the aperture 22, recess 24, ledge portion 26 and vertical slot 28 in each of the magazine blocks 18. The aperture 86, recess 88 and vertical slot 92 in the clamping bracket 84 are thus respectively aligned with the continuous bore 22', groove 24' and grooves 28', respectively, in the assembly of the magazine blocks 18. The clamping bracket 84 is further formed with holes (not numbered) which are respectively similar to the through holes 30, 32, 34 and 36 in each of the magazine blocks 18 and are thus aligned with the continuous bores 30', 32', 34' and 36' in the assembly of the magazine blocks 18. The clamping bracket 84 has a horizontal limb portion 94 projecting from below the aperture 86 outwardly in the longitudinal direction of the detector assembly 10 over the upper face of the horizontal bottom wall portion 70 of the external support plate 68. The bracket 84 further has at its lower end a pair of leg portions only one of which is shown at 96 in FIG. 6 and is fixedly mounted on the external support plate 68 by suitable fastening means such as a screw 98 securing the leg portion 96 to the upper face of the horizontal bottom wall portion 70 of the support plate 68. The clamping bracket 84' at the other side end of the assembly of the magazine blocks 18 is configured and arranged similarly to the above described bracket 84 as will be understood from the illustration of FIG. 2 in which the bracket 84' is shown having a limb portion 94'.

The clamping brackets 84 and 84' and the assembly of the detecting units 16 are fixedly but disconnectably combined together by connecting rods 100, 102 and 104 which are respectively passed through the continuous bores 32', 34' and 36' in the assembly of the magazine blocks 18 and through those holes in the brackets 84 and 84' which are respectively aligned with these bores 32', 34' and 36'. Likewise, the shaft 42 supporting the respective light-intercepting elements 44 of the individual detecting units 16 is passed through the continuous bore 30' in the assembly of the magazine blocks 18 and through the corresponding holes in the brackets 84 and 84'. Each of the shaft 42 and connecting rods 100, 102 and 104 has screw threaded end portions and is clamped to the brackets 84 and 84' by means of nuts fitted to the threaded end portions, though not seen in the drawings.

The casing structure 66 of the detector assembly 10 further comprises a pair of side end brackets 106 and 106' which are located at both side ends of the detector assembly 10. The side brackets 106 and 106' have similar configurations and, for this reason, the detailed construction of only one of them, 106, is shown in FIGS. 3, 5 and 6. As shown, the side end bracket 106 has a depth greater than the depth of the external support plate 68 and a height slightly greater than the height of the assembly of the magazine blocks 18 and clamping brackets 84 and 84' and has formed in its upper end wall portion a side groove 108 which is open at its rear end and along the inner side end of the bracket 106. A horizontal upper cover 110 forming another part of the casing structure 66 has one side edge portion detachably received in this side groove 108 as seen in FIGS. 3 and 5 and the other side edge portion detachably received in a side groove similarly formed in the other side end bracket 106' and thus extends over the assembly of the magazine blocks 18 and the clamping brackets 84 and 84' as will be seen in FIG. 2. The side end brackets 106 and 106' are fixedly connected together by a connecting rod 112 which is passed through the previously described elongated open space formed between the spaced parallel vertical wall portions of the external and internal support plates 68 and 74. The side bracket 106 further has formed in the upper wall portion thereof a groove 114 which is open at its upper end and which has a bottom end portion which is semicircularly curved about a center axis substamtially parallel with the longitudinal direction of the detector assembly 10, the bottom end of the groove 114 being located on a horizontal plane which is slightly above the upper end of the assembly of the magazine blocks 18 and the clamping brackets 84 and 84' as will be seen from FIG. 3. A guide bar 116 having a circular cross section is received at one end on the side end bracket 106 through the groove 114 and at the other end thereof on the side end bracket 106' through a groove (not shown) formed in the bracket 106' similarly to the groove 114 in the bracket 106. The groove 114 in the side end bracket 106 and the corresponding groove in the side end bracket 106' are located so that the guide bar 116 extends in parallel with the longitudinal direction of the detector assembly 10 slightly rearwardly of the yarn-pass element 56 on each light-intercepting element 40 in the previously described first angular position thereof, as seen in FIG. 3. The guide bar 116 is securely but detachably clamped to the side end brackets 106 and 106' by suitable fastening means such as a clamping screw 118 fitting in a screw hole 120 formed in the upper end wall portion adjacent to the groove 114 as shown in FIG. 6.

The side end bracket 106 is formed with an opening 122 for passing lead wires therethrough as will be described later and openings 124 and 124' through which the bracket 106 is fixedly mounted on the supporting column 14 (FIG. 1) of the previously described frame structure. The side end bracket 106 further has a guide wall portion 126 having a substantially flat upper face extending forwardly away from the front cover 78. Though not shown in the drawings, the side end brackets 106 and 106' are fixedly but detachably connected to the external support plate 68 by suitable fastening means so that the detector assembly 10 as a whole is securely supported by the supporting columns 14 and 14'.

On the other hand, the guide structure 12 of the apparatus embodying the present invention comprises a pair of supporting plates only one of which is shown at 128 in FIG. 3, 5 and 6. The supporting plate 128 has a vertical rear wall portion 130 substantially perpendicular to the longitudinal direction of the detector assembly 10 and a vertical front end wall portion 132 formed at the front end of the rear wall portion 130 substantially in parallel with the longitudinal direction of the detector assembly 10. The supporting plate 128 has formed in the rear wall portion 130 a pair of spaced parallel horizontal grooves 134 extending substantially perpendicularly to the longitudinal direction of the detector assembly 10 and has the rear wall portion 130 securely but detachably attached to the inner side face of the side end bracket 106 by means of a clamping plate 136 which is formed with holes 138 respectively vertically aligned with the grooves 134 in the rear wall portion 130 of the supporting plate 128 as seen in FIG. 5 and which is securely but detachably attached as seen in FIGS. 3 and 6 to the inner side face of the rear wall portion 130 of the supporting plate 128 by suitable fastening means such as bolts 140 which are respectively passed through the holes 138 in the clamping plate 136 and the grooves 134 in the rear wall portion 130 of the supporting plate 128 and further through holes (not shown) formed in the side end bracket 106. The bolts 140 are tightened to the side end bracket 106 on the outer side of the bracket 106, though not shown in the drawings. The fore-and-aft position of the supporting plate 128 relative to the side end bracket 106 is, thus, adjustable by varying the respective longitudinal positions of the grooves 134 in the rear wall portion 130 of the supporting plate 128 with respect to the above mentioned holes in the side end bracket 106 and accordingly to the holes 138 in the clamping plate 136. The rear wall portion 130 of the supporting plate 128 has its lower end in contact with the upper face of the guide wall portion 126 of the side end bracket 106. The supporting plate 128 is further formed with internally threaded holes 142 each open at the front end of the plate 128 and having a horizontal center axis which is substantially perpendicular to the longitudinal direction of the detector assembly 10, as indicated by dotted lines in FIG. 3. In like manners, the other supporting plate forming part of the guide structure 12 is detachably and adjustably connected to the side end bracket 106' shown in FIG. 2 by means of a clamping plate and bolts which are arranged similarly to the above described clamping plate 136 and bolts 140, though not illustrated in the drawings.

The guide structure 12 further comprises a horizontally elongated front end plate 144 which is formed with internally threaded through holes 146 respectively aligned with the internally threaded holes 142 in one supporting plate 128. Though not shown in the drawings, the front end plate 144 is further formed with internally threaded holes respectively aligned with the internally threaded holes formed in the other supporting plate attached to the side end bracket 106' (FIGS. 1 and 2) similarly to the holes 142 in the supporting plates 128. The front end plate 144 is fixedly but detachably connected at one longitudinal or side end thereof to the front end wall portion 132 of one supporting plate 128 by bolts 148 and at the other longitudinal or side end thereof to the front end wall portion of the other supporting plate attached to the side end bracket 106' by bolts 148' (FIG. 1), horizontally extending in parallel with the longitudinal direction of the detector assembly 10 and forwardly spaced apart from the assembly of the detecting units 16.

The front end plate 144 is formed with a number of holes 150 which are respectively aligned with the eyelets 58 in the yarn-pass elements 56 on the individual light-intercepting elements 40 in the previously defined first angular positions thereof as will be seen from FIG. 3. A yarn guide element 152 having an eyelet 154 is fitted to the front end plate 144 through each of the holes 150 thus formed in the plate 144.

The apparatus embodying the present invention further comprises a light-emitting unit 156 removably mounted on the limb portion 94' of the clamping bracket 84' within one of the open spaces on both sides of the assembly of the detecting units 16 as shown in FIG. 2. The light-emitting unit 156 includes a projector lamp 158 which is located in proximity to one longitudinal end of the continuous bore 22' in the assembly of the magazine blocks 18 and clamping brackets 84 and which 84' and is adapted to project a beam of light into the bore 22' when energized. Likewise, a light-sensitive signal generating unit 160 is removably mounted on the limb portion 94 of the clamping bracket 84 within the other of the open spaces on both sides of the assembly of the detecting units 16. The light-sensitive generating unit 160 includes a suitable photoelectric transducer 162 which is herein assumed to be a photoconductive cell constructed of a semiconductor based on cadmium sulfide (CdS). The light-emitting unit 156 and the light-sensitive signal generating unit 160 are electrically connected to a suitable control circuit 166 by lines 168. The electric lines or conductors 168 are passed through the continuous groove 24' in the assembly of the magazine blocks 18 as indicated in FIG. 3 and are drawn out of the detector assembly 10 through the opening 122 in the side end bracket 106 (FIG. 6) and the corresponding opening in the side end bracket 106' though not shown in the drawings. Designated by 164 (FIG. 7) is an indicator lamp which is adapted to be energized when an unusual condition, viz., a break or undue slackening of a yarn is detected.

In operation, the individual yarns 60 to be used in the weaving, spinning or other yarn manipulating process are respectively passed through the eyelets 58 in the yarn-pass elements 56 on the individual light-intercepting elements 40 of the detector assembly 10 and further through the eyelets 154 in the individual yarn guide elements 152 on the front end plate 144 of the guide structure 12. If, in this instance, the number of the yarns 60 is in short of the number of the detecting units 16 and as a consequence some of the detecting units 16 are to be out of use for the operation, the light-intercepting elements 40 of such surplus detecting units 16 are preliminarily moved by finger pressures into the previously described third angular positions thereof and are held in the particular positions by means of the retainer springs 62 of the units 16 as indicated by the dot-and-dash lines in FIG. 4 so that the respective apertures 22 in the magazine blocks 18 of the particular detecting units are kept open throughout the operation. When the yarn 60 passed through the eyelet 58 in each yarn-pass element 56 and the eyelet 154 in each yarn guide element 152 is properly tensioned, the yarn 60 extends substantially straight in a horizontal direction over the upper cover 110 forming part of the casing structure 66. The yarn-pass element 56 passing the particular yarn 60 therethrough is therefore retained in a raised vertical position holding the associated light-intercepting element 40 in the previously mentioned first angular position thereof as shown in FIG. 3, having the inner arm portion 46 of the light-intercepting element 40 in the downwardly inclined position and thus allowing the aperture 22 in the magazine block 18 to be open to the aperture 22 in the neighboring magazine block 18. If, therefore, all the yarns 60 in use are properly tensioned, the yarn-pass elements 56 of all the detecting units 16 that are in use are held in the raised positions thereof holding the respectively associated light-intercepting elements 40 in the first angular positions thereof as illustrated in FIG. 2 so that there is no light-intercepting element 40 assuming the second angular position thereof. Under these conditions, the apertures 22 in the magazine blocks 18 of all the detecting units 16 constituting the detector assembly 10 are allowed to open to the apertures 22 in the neighboring magazine blocks 18 and thus constitute the elongated bore 22' which is open and continuous throughout the length of the assembly of the detecting units 16. The beam of light issuing from the projector lamp 158 of the light-emitting unit 156 located in proximity to one axial end of the continuous bore 22' is therefore allowed to pass throughout the length of the bore 22' and reach the photoconductive cell 162 of the light-sensitive signal generating unit 160 located in proximity to the other axial end of the bore 22'. The photoconductive cell 162 thus delivers a constant current to the control circuit 166. In the event any one of the yarns 60 in use happens to break or unusually slacken, the light-intercepting element 40 supporting the yarn-pass element 56 allocated to the particular yarn 60 turns about the center axis of the shaft 42 into the second angular position thereof having the aperture 22 in the magazine block 18 of the particular detecting unit 16 convered by the inner arm portion 46 of the light-intercepting elements 40, as indicated by broken lines in FIG. 4. Under these conditions, the bore 22' in the detector assembly 10 is closed by the inner arm portion 46 of the particular light-intercepting element 46 so that the beam of light emitted from the projector lamp 156 is intercepted in the closed aperture 22. In the absence of light reaching the photoconductive cell 162, the resistance of the photoconductive cell 162 is augmented and as a consequence the output current delivered therefrom declines.

FIG. 7 illustrates a preferred example of the circuit arrangement of the control circuit 166 which is thus responsive to the output current from the photoconductive cell 162. Referring to FIG. 7, the control circuit 166 comprises a d.c. and a.c. power supply unit 170 connected to a mains a.c. power source 172 through a switch 174 and a fuse 176. The power supply circuit 170 comprises a transformer 178 having its primary winding connected across the a.c. power source 172 through the above mentioned switch 174 and fuse 176 and its secondary winding connected to a full-wave rectifier 180 constructed by a bridge network of diodes and having positive and negative output terminals which are respectively connected to bus lines 182 and 184. Between the positive and negative bus lines 182 and 184 may be connected a smoothing capacitor (not shown). The power supply unit 170 further comprises a transformer 186 which has its primary winding connected across the a.c. power source 172 through the switch 174 and fuse 176 and its secondary winding connected at one terminal to a line 188 and at the other terminal to a line 190 through a coil 192. The coil 192 forms part of a relay 194 connected to a solenoid-operated actuator 196 of a suitable stop motion (not shown) adapted to brake the yarn manipulating equipment when actuated. Designated by 198 is an indicator lamp which is connected across the a.c. power source 172 through the switch 174 and the fuse 176 for being energized when the switch 174 is closed.

The projector lamp 158 is connected between the line 188 from the a.c. power supply circuit and the negative bus line 184, while the photoconductive cell 162 has an input terminal connected to the positive bus line 182 and an output terminal connected through a variable resistor 200 to the line 190 connected through the relay coil 192 to the a.c. power supply circuit. A thyristor 204 has its anode terminal connected to the line 188 from the a.c. power supply circuit and its cathode terminal connected through a diode 202 to the line 190 connected through the relay coil 192 to the a.c. power supply circuit. An n-p-n transistor 206 has its base connected between the output terminal of the photoconductive cell 162 and the variable resistor 200 and its emitter electrode connected between the variable resistor 200 and the negative bus line 182. The collector electride of the transistor 206 is connected through a resistor 208 to the positive bus line 180 and through a resistor 210 to the gate terminal of the thyristor 204. Between the thyristor 204 and the diode 202 is connected the previously described indicator lamp 164 (FIG. 1).

When the beam of light emitted from the projector lamp 158 is allowed to reach the photoconductive cell 162 in the absence of a yarn which is broken or unusually slackened, the photoconductive cell 162 exhibits a relatively low resistance and thus maintains the transistor 206 conductive. The current in the positive bus line 180 is therefore passed through the resistor 208 and the transistor 206 to the negative bus line 182. In the absence of the current flowing through the resistor 210, the thyristor 204 remains non-conductive so that the relay coil 192 is kept deenergized. When, however, the beam of light from the projector lamp 158 is intercepted and the photoconductive cell 162 is not irradiated with the light, the resistance of the photoconductive cell 162 is increased and as a consequence the transistor 206 is rendered non-conductive. The alternating current in the line 188 is passed through the series combination of the resistors 208 and 210 to the gate terminal of the thyristor 204, which is accordingly rendered conductive for the durations of the positive half cycles of the alternating current and energizes the relay coil 192 through the diode 202 and the line 190. The relay 194 is now closed and energizes the solenoid-operated actuator 196. When servicing of the yarn in improper condition is complete and the photoconductive cell 162 is allowed to receive the beam of light from the projector lamp 158 for a second time, the transistor 206 is made conductive so that the current at the gate terminal of the thyristor 204 disappears. The thyristor 204 is therefore rendered non-conductive by the first negative half cycle of the alternating current appearing at the anode terminal thereof after the trigger current at the gate terminal of the thyristor has disappeared. The relay coil 192 is therefore de-energized and accordingly the relay 194 is made open, thereby causing the solenoid-operated actuator 196 to be de-energized.

In the event the yarn allocated to any one of the detecting units 16 happens to be temporarily slackened and consequently the light-intercepting element 40 of the particular detecting unit 16 is suspended from the yarn in a position between the first and second angular positions thereof, the bore 22' in the detector assembly 10 is partially closed by the inner arm portion 46 of the light-intercepting element 40 and the beam of light emitted into the bore 22' from the projector lamp 158 is partially intercepted in the bore 22' and partially transmitted to the photoconductive cell 162. When this occurs, the output voltage of the photoconductive cell 162 varies continuously between the value responsive to the total quantity of the light from the projector lamp 158 and the value achieved when the beam of light is totally intercepted. The level of the voltage at which the transistor 206 is to be turned off is adjustable by the variable resistor 200 so that the thyristor 204 can be made conductive when the quantity of light reaching the photoconductive cell 162 is reduced to a predetermined fraction of the total quantity of the light emitted from the projector lamp 158.

FIG. 8 illustrates a modification of the detecting unit 16 incorporated in the embodiment of the apparatus according to the present invention as hereinbefore described with reference to FIGS. 1 to 7. In FIG. 8, the detecting unit per se, the magazine block and light-intercepting element of the detecting unit and the inner arm portion of the light-intercepting element are designated by 16', 18', 40' and 46', respectively, and the remaining elements, members and spaces corresponding to those of the detecting unit 16 shown in FIG. 4 are designated by the same reference numerals as in FIG. 4 except for an aperture 212 formed in the magazine block 18' as an alternative to the aperture 22 in the magazine block 18 of the detecting unit 16 shown in FIG. 4. The light-intercepting element 40' of the detecting unit 16' shown in FIG. 8 has a first angular position which is similar to the first angular position of the light-intercepting element 40 of the embodiment of FIGS. 1 to 7 and in which the inner arm portion 46' assumes a downwardly inclined position uncovering the aperture 212 in the magazine block 18' as indicated by full lines in FIG. 8. When the yarn passed through the yarn-pass element 56 supported by the light-intercepting element 40' is broken or unusually slackened and as a consequence the outer arm portion 44 of the light-intercepting element 40' is turned downwardly, the inner arm portion 46' of the light-intercepting element 40' is turned upwardly past the open end of the aperture 212 in the magazine block 18' and instantaneously covers the open end of the aperture 212. The light-intercepting element 40' thus turned past the open end of the aperture 212 is stopped in a predetermined limit position having the outer arm portion 44 downwardly inclined and the inner arm portion 46' upwardly inclined as indicated by dotted lines in FIG. 8. The angular position of the light-intercepting element 40' corresponding to the second angular position of the light-intercepting element 40 of the detecting unit 16 shown in FIG. 4 is, thus, assumed only instantaneously by the element 40' being turned from the above mentioned first angular position thereof toward the above mentioned limit position. The control circuit (not shown) for use with the detector assembly composed of the detecting units 16' is therefore arranged in such a manner as to pick up an impulse produced at the output terminal of the photoconductive cell 162.

FIG. 9 illustrates a portion of an arrangement in which the detector assembly 10 is modified to permit adjustment of the intervals between the yarn-pass elements 56 of the individual detecting units. In the arrangement shown in FIG. 9, each of the detecting units comprises, in addition to the magazine block 18 (or 18', though not shown), a spacer element 214 having a desired thickness and interposed between every neighboring two of the magazine blocks 18. The thickness of each of the spacer elements 214 is selected to provide desired spacings between the individual yarns to be in use so that all the detecting units to be used are in alignment with the yarns respectively allocated to the detecting units.

What is claimed is:

1. An apparatus for detecting a break or unusual slackening of a yarn in a plurality of yarns, comprising:

a detector assembly consisting of a plurality of detecting units juxtaposed end-to-end in a longitudinal direction, each of the detecting units comprising a magazine block having front and rear ends substantially parallel with said longitudinal direction and formed with an aperture open at both side ends of the magazine block, the apertures in the magazine blocks of the individual detector units having respective center axes substantially in line with one another, said apertures forming an elongated continuous bore throughout said magazine blocks substantially in parallel with said longitudinal direction: a light-intercepting element which is rotatable about an axis of rotation through said magazine block and substantially parallel with said longitudinal direction and which projects outwardly from the front end of the magazine block, the light-intercepting element being rotatable about said axis of rotation between a first angular position uncovering the aperture at one axial end of the aperture, a second angular position in part covering the aperture at said axial end and a third angular position opposite to said second angular position across said first angular position and uncovering said aperture, said light-intercepting element being in said first angular position by a properly tensioned yarn engaging the element and in said third angular position when the detecting unit including the intercepting element is to be out of use; biasing means urging said light-intercepting element to turn toward said second angular position about said axis of rotation; stop means for bearing said light-intercepting element thereon when the light-intercepting element is in said second angular position; and manually-operated retaining means supported on said magazine block for releasably holding said light-intercepting element in said third angular position thereof;

light-emitting means which is positioned externally of and in proximity to the aperture in the magazine block disposed at one longitudinal end of said detector assembly and which is operative to project a beam of light into said bore; and light-sensitive signal generating means positioned externally of and in proximity to the aperture in the magazine block at the other longitudinal end of said detector assembly and operative to deliver a signal in response to the beam of light emitted from said light-emitting means and reaching said signal generating means through said bore.

2. An apparatus as set forth in claim 1, wherein said light-intercepting element comprises an outer arm portion extending forwardly from said axis of rotation and projecting outwardly from the front end of said magazine block and an inner arm portion extending rearwardly from said axis of rotation, said inner arm portion being disposed out of alignment with said aperture during the disposition of said light-intercepting element in said first and third angular positions and being located at said axial end of said aperture when said light-intercepting element is in said second angular position thereof, each of said detector units further comprising a yarn-pass element mounted on said outer arm portion and movable with said light-intercepting element between a first vertical position having a properly tensioned yarn passing therethrough, a second vertical position lower than said first vertical position and a third vertical position higher than said first vertical position, said light-intercepting element being in said first, second and third angular positions thereof when said yarn-pass element is in said first, second and third vertical positions, respectively, thereof.

3. An apparatus as set forth in claim 2, wherein said light-intercepting element and said yarn-pass element are formed to establish about said axis of rotation, a torque urging said light-intercepting element to turn toward said second angular position thereof, said biasing means being provided by said torque.

4. An apparatus as set forth in claim 2, in which said light-intercepting element has formed in said outer arm portion thereof a hole for fixedly securing a solid mass to the outer arm portion through said hole.

5. An apparatus as set forth in claim 4, in which said solid mass is formed by a weld at least in part filling in said hole in the outer arm portion of the light-intercepting element.

6. An apparatus as set forth in claim 1, in which said magazine block has formed in one of its side walls a depression which is open at the front end of the magazine block, the angular movement of said inner arm portion of the light-intercepting element being accommodated in said depression.

7. An apparatus as set forth in claim 1, in which said magazine block has a land portion defining a portion of said depression and formed with a groove open to said depression in a direction substantially perpendicular to said longitudinal direction of the detector assembly and in which said light-intercepting element has formed in said inner arm portion thereof a notch in the vicinity of said land portion, said retaining means comprising a retainer spring which has one end portion anchored to said land portion through said groove and the other end portion extending in said depression and formed with a hook engageable with said light-intercepting element through said notch in the inner arm portion of the element, said retainer spring being in retaining engagement with said light-intercepting element through said notch when the light-intercepting element is in said third angular position thereof.

8. An apparatus as set forth in claim 1, in which said magazine block has formed in its rear wall a recess open at the rear end and side ends of the rear wall, the respective recesses in the magazine blocks of the individual detecting units being substantially aligned with one another and forming an elongated continuous groove throughout the length of the assembly of the detecting units substantially in parallel with said longitudinal direction of the detector assembly.

9. An apparatus as set forth in claim 8, in which said magazine block has a ledge portion projecting rearwardly above said recess and formed with a vertical slot which is open at the lower end and side ends of said ledge portion, the respective slots in the magazine blocks of the individual detecting units being substantially aligned with one another and forming an elongated continuous groove throughout the length of the assembly of the detecting units substantially in parallel with said longitudinal direction of the detector assembly.

10. An apparatus as set forth in claim 1, in which said detector assembly comprises a casing structure supporting the assembly of said detecting units and said light-emitting and light-sensitive signal generating means therewithin and including a pair of brackets respectively positioned at both longitudinal ends of the assembly of said detecting units, each of said brackets having a substantially horizontal limb portion extending outwardly away from each of said longitudinal ends in said longitudinal direction of the detector assembly, said light-emitting means being detachably supported on the limb portion of one of said brackets and said light-sensitive signal generating means being supported on the limb portion of the other bracket.

11. An apparatus as set forth in claim 10, in which each of said magazine block and said brackets is formed with at least one through hole which is open at both side ends of each of the magazine blocks and the brackets, the respective through holes in the magazine blocks and the brackets being substantially aligned with one another and forming an elongated continuous bore throughout the length of the assembly of the detecting units and the brackets substantially in parallel with said longitudinal direction of said detector assembly, said detector assembly further comprising an elongated connecting rod which is passed through the bore constituted by said through holes and which is releasably clamped at both axial ends thereof to said brackets for clamping said detecting units between said brackets.

12. An apparatus as set forth in claim 11, in which each of said magazine blocks and said brackets is formed with an additional through hole which is open at both side ends of each of the magazine blocks and the brackets and which has a center axis coincident with said axis of rotation, the respective additional through holes in the magazine blocks and the brackets being substantially aligned with one another and forming an elongated continuous bore throughout the length of the assembly of the magazine blocks and the brackets substantially in parallel with said longitudinal direction of said detector assembly, said detector assembly further comprising an elongated shaft which is passed through the bore constituted by said additional through holes and which is releasably clamped at both axial ends thereof to said brackets, the respective light-intercepting elements of said detecting units being rotatably mounted on said shaft.

13. An apparatus as set forth in claim 12, in which each of said brackets is formed with an aperture aligned with the respective apertures in the magazine blocks of said detecting units.

14. An apparatus as set forth in claim 13, in which each of said magazine blocks and said brackets has formed in its rear wall a recess which is open at the rear end and side ends thereof, the respective recesses in the magazine blocks and the brackets being substantially aligned with one another and forming an elongated continuous groove throughout the length of the assembly of the detecting units and the brackets substantially in parallel with said longitudinal direction of the detector assembly.

15. An apparatus as set forth in claim 14, in which each of said magazine blocks and said brackets has a ledge portion projecting rearwardly above said recess and formed with a vertical slot which is open at the lower end and side ends of the ledge portion, the respective slots in the magazine blocks and the brackets being substantially aligned with one another and forming an elongated continuous groove throughout the length of the assembly of the detecting units and the brackets substantially in parallel with said longitudinal direction of said detector assembly.

16. An apparatus as set forth in claim 10, in which said casing structure further includes a pair of side end brackets located at both longitudinal ends of said detector assembly and each having a front wall portion projecting forwardly from the vertical plane containing the front end of the assembly of said detecting units.

17. An apparatus as set forth in claim 16, further comprising a guide structure positioned in front of the assembly of said detecting units and detachably mounted on the respective front wall portions of said side end brackets, the guide structure including a plurality of yarn guide elements respectively located substantially in alignment with the yarn-pass elements in said first vertical positions in directions substantially perpendicularly to said longitudinal direction of said detector assembly.

18. An apparatus as set forth in claim 17, in which each of said side end brackets is formed with holes in said front wall portion thereof and in which said guide structure further includes a pair of supporting plates each having a rear wall portion formed with grooves extending substantially perpendicularly to said longitudinal direction of said detector assembly and spaced apart from each other a distance substantially equal to the spacing between said holes in said side end bracket, the supporting plates being respectively attached to said front wall portions of said side end brackets with the grooves in each of the supporting plates respectively aligned in part with the holes in each of said side end brackets, and clamping means for detachably clamping said supporting plates to the front wall portions of said side end brackets, respectively, through said grooves in the supporting plates and the holes in the side end brackets, the position of said guide structure relative to said detector assembly in a direction perpendicular to said longitudinal direction of the detector assembly being adjustable by varying the respective longitudinal positions of the grooves in said supporting plates relative to the holes in said side end brackets.

19. An apparatus as set forth in claim 16, in which each of said side end brackets has an upper end wall portion formed with a groove having an open upper end and a closed bottom end, the respective grooves in the brackets being aligned with each other in a direction substantially parallel with said longitudinal direction of said detector assembly and rearwardly of the first vertical positions of the yarn-pass elements of said detecting units, said casing structure further including a guide bar which has its opposite axial end portions releasably received in the grooves in said side end brackets, said guide bar having its upper end located rearwardly of the yarn-pass elements in the first vertical positions thereof.

20. An apparatus as set forth in claim 22, in which said magazine block has a land portion located so that said light-intercepting element is brought into abutting engagement with the land portion when rotated in said second angular position thereof.

* * * * *